US005478146A

United States Patent [19]

Grabher

[11] Patent Number: 5,478,146

[45] Date of Patent: Dec. 26, 1995

[54] HOLLOW CHAMBERED DRAWER SIDE SLIDE MADE FROM METAL MATERIALS

[75] Inventor: Günter Grabher, Obere Eichwaldstrasse, Germany

[73] Assignee: Grass AG, HOchst/Vlbg., Austria

[21] Appl. No.: 224,952

[22] Filed: Apr. 8, 1994

[30] Foreign Application Priority Data

Apr. 16, 1993 [DE] Germany ..... 9305716 U
Dec. 24, 1993 [DE] Germany ..... 9319913 U

[51] Int. Cl.[6] ..... A47B 88/00
[52] U.S. Cl. ..... 312/348.1
[58] Field of Search ..... 312/348.1, 348.2, 312/297, 330.1, 334.1

[56] References Cited

U.S. PATENT DOCUMENTS 4,579,402 4/1986 Wenzlick et al. ..... 312/330.1
5,180,217 1/1993 Lautenschlager ..... 312/330.1 X
5,292,190 3/1994 Lautenschlager et al. ..... 312/330.1

FOREIGN PATENT DOCUMENTS 551575 7/1993 European Pat. Off. ..... 312/348.2
567789 11/1993 European Pat. Off. ..... 312/348.1

*Primary Examiner*—Kenneth J. Dorner
*Assistant Examiner*—Robert J. Sandy
*Attorney, Agent, or Firm*—Petree Stockton

[57] ABSTRACT

A hollow chambered metal drawer side slide for a drawer includes two drawer side slide components, one of which is arranged inside the other forming overlapping wall areas, and the drawer side slide components are connected in the wall areas by a jointed flange connection.

3 Claims, 2 Drawing Sheets

HOLLOW CHAMBERED DRAWER SIDE SLIDE MADE FROM METAL MATERIALS

BACKGROUND OF THE INVENTION

The present invention concerns a hollow chambered drawer side slide for a drawer in which a hollow chambered drawer side slide is produced from a metal material, especially sheet metal. The sheet metal is bent in corresponding contours to form the side walls, respectively, and the back wall of the drawer.

It has been shown that with the production of this type of hollow chambered drawer side slide, great stability with small sheet metal thickness is desired in order to keep the total drawer weight down, but yet, to attain an optimal stability and sturdiness.

SUMMARY OF THE INVENTION

An object of the present invention, therefore, is to further develop a hollow chambered drawer side slide of the type described in the introduction, so that optimal stability and durability of the hollow chambered drawer side slide is guaranteed with the least sheet metal thickness possible.

A fundamental feature of the invention is that the drawer side slide consists fundamentally of two drawer side slide components which are connected to each other. These drawer side slide components engage into one another and are connected with each other so that in the location of the greatest mechanical load there is a doubled wall thickness and strength.

The drawer side slide components are positioned, partially doubled, in the lower area of the drawer and are connected with each other with special connecting techniques.

In a first embodiment of the invention, the drawer side slide consists of two components which are separated from each other. These components are connected fitting to each other in overlapping relationship in the wall area. Suitable connections are considered to be, for example, rivets, flanges, welding, as well as cold welding, cold pressing and adhesion. Any combination of these connections is possible.

An additional embodiment of the invention provides that the drawer side slide consists of two drawer side slide components which are connected with each other and are made from one piece of material. These drawer side slide components are simply bent around, fitting to each other. The connection in the wall area can be undertaken as in the first embodiment.

The inventive basis of the submitted innovation results from not only the matter of the individual protection claims, but also the various combinations of the individual protection claims.

All records, documents and evidence, inclusive of the summary, open and disclosed statements, declarations, indications and features, especially those represented embodiments in the drawings, will be claimed as fundamental and significant to the invention, as far as the claims, individually or in combinations, are relative to the position that the technology is new.

The innovation on hand is more closely explained by representative drawings of several execution methods. Hereby, additional significant and fundamental features and advantages of the innovation follow from the drawings and their descriptions.

DETAILED DESCRIPTION OF THE PREFERRED EMBODIMENT

Two embodiment examples are presented in the FIGS. 1 to 4; whereby, two corresponding drawer side slide components (2,3) are connected to form a drawer side slide (1). The connection takes place in the wall area (8) which results here fundamentally from overlapping areas of both vertical shanks (4 and 5).

Figure 1:
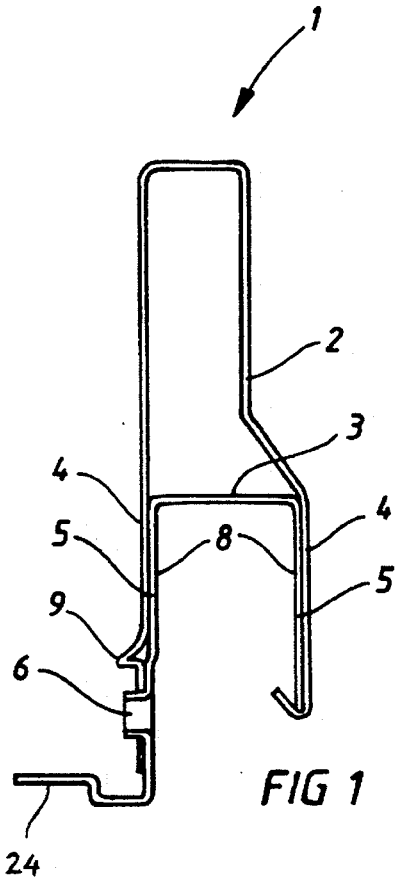
FIG. 1 is a section through the first embodiment of the drawer side slide with a rivet connection in an assembled position.
Figure 2:
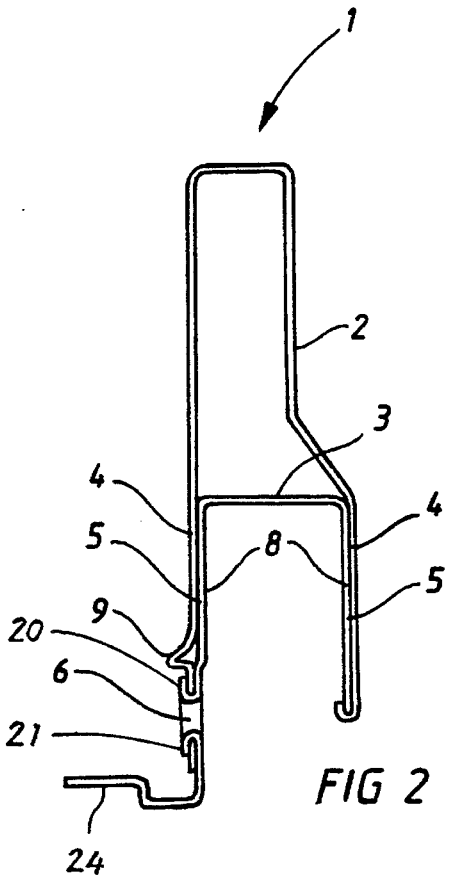
FIG. 2 is a section through the drawer side slide with a finished riveted connection, according to FIG. 1.
Figure 3:
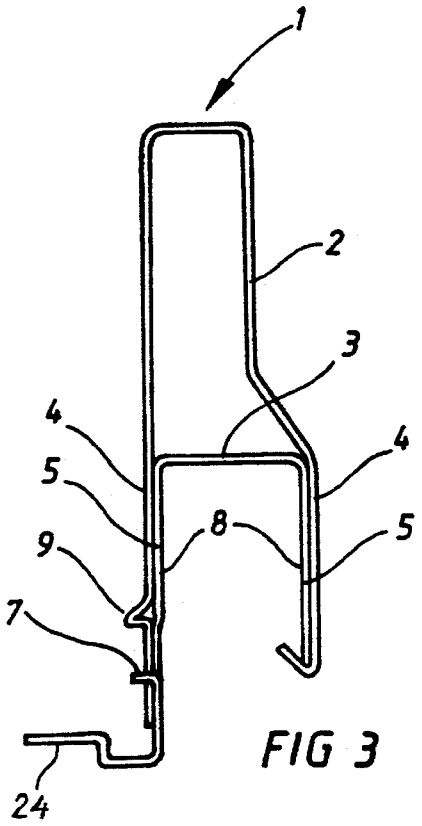
FIG. 3 is a section through an additional embodiment of the drawer side slide with a flange connection in an assembled position.
Figure 4:
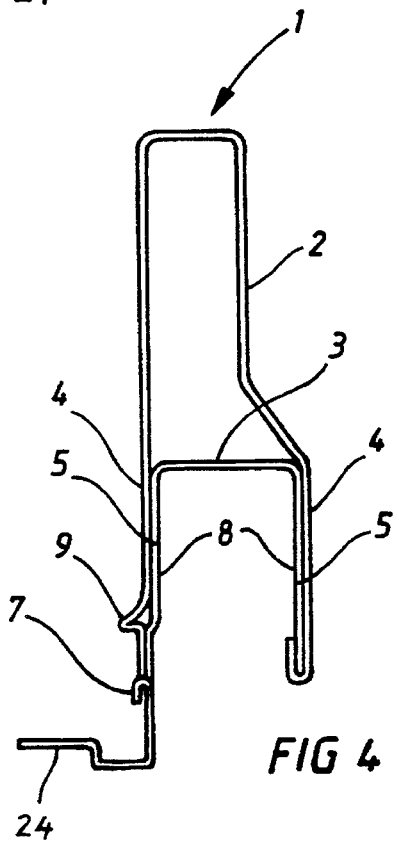
FIG. 4 is a section through the embodiment of FIG. 3 with assembled flange connection.

In the FIGS. 1 and 2, a connection over a rivet (6) is shown; in the FIGS. 3 and 4, an alternative connection by means of a flange (7) is shown.

Respective flange connections, namely upper flange connection (20) and lower flange connection (21), as shown in FIG. 2, lie on opposite sides of the rivet, and both shanks (4,5) are likewise connected on a flange.

Figure 6:
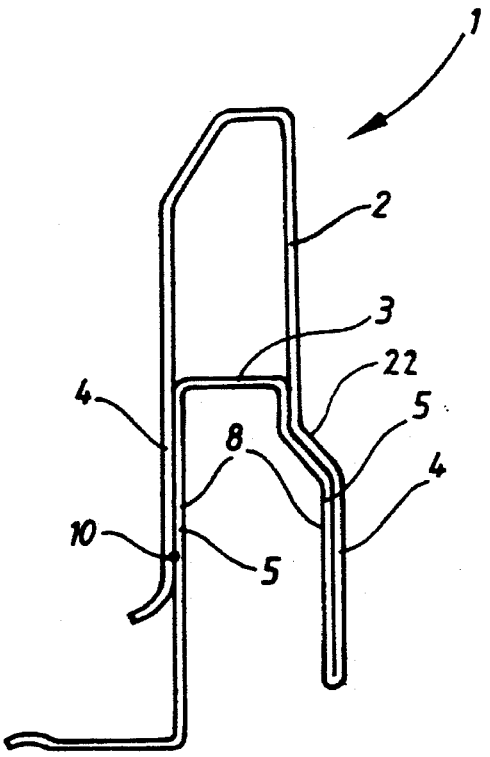
FIG. 6 is a drawer side slide with connected drawer side slide components.
Figure 5:
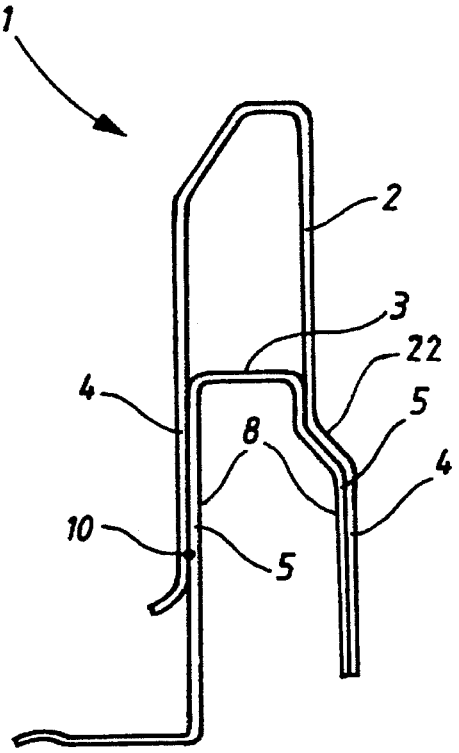
FIG. 5 is a section through a third embodiment of the drawer side slide.

In the FIGS. 5 and 6, two additional embodiments are represented in which the connection between the drawer side slide components (2,3) results from one or more welding points (10), and in which upper and lower drawer side slide components (2,3) include slanted portions overlapping each other to form a slanted wall area (22).

In FIGS. 5, the drawer side slide components (2,3) are separated from each other and in FIG. 6, the drawer side slide components are produced from one piece of material.

The embodiment, according to FIG. 6, is a connection of the drawer side slide components (2,3) in which the connection in the right-hand wall area (8) is unnecessary.

Obviously, it is possible to combine the method which is embodied here with an adhesive connection.

This type of connection, as well as the other additional connection methods, such as cold welding and cold pressing, can likewise be utilized.

The embodiment examples, according to FIGS. 1 through 4, can be additionally provided with welding points.

The drawer side slide components (2) run along to the interior of the drawer, according to the FIGS. 1 to 4, preferably with a portion slanted inwards to form a drawer curve (9) spaced from bottom ledge (24) of drawer side slide component (3) and which overlaps an inlaid drawer bottom and holds the drawer bottom snugly in the interior of the drawer.

I claim:

1. A hollow chambered metal drawer side slide for a drawer having a drawer bottom, comprising:

an upper drawer side slide component having two upper component vertical shanks;

a lower drawer side slide component having two lower component vertical shanks and arranged within the upper drawer side slide component with the upper component vertical shanks superposing the lower component vertical shanks forming two overlapping wall areas, and the upper and lower drawer side slide components are connected in the wall areas by a connection operatively joining to a flange, said upper and lower drawer side slide components including slanted portions overlapping each other and forming a slanted wall area.

2. A hollow chambered metal drawer side slide for a drawer having a drawer bottom, comprising:

an upper drawer side slide component having two upper component vertical shanks;

a lower drawer side slide component having two lower component vertical shanks and arranged within the upper drawer side slide component with the upper component vertical shanks superposing the lower component vertical shanks forming two overlapping wall areas, and the upper and lower drawer side slide components are connected in the wall areas by a connection operatively joining to a flange, said upper drawer side slide component having a curved portion for overlapping and holding said drawer bottom and said lower drawer side slide component having a bottom ledge spaced from the curved portion, wherein said connection operatively joining to a flange is disposed between said curved portion and said bottom ledge.

3. A hollow chambered metal drawer side slide for a drawer having a drawer bottom, comprising:

an upper drawer side slide component having two upper component vertical shanks;

a lower drawer side slide component having two lower component vertical shanks and arranged within the upper drawer side slide component with the upper component vertical shanks superposing the lower component vertical shanks forming two overlapping wall areas, and the upper and lower drawer side slide components are connected in the wall areas by a connection operatively joining to a flange, wherein said connection operatively joining to a flange is combined with a rivet connection, and wherein said connection operatively joining to a flange includes an upper flange connection and a lower flange connection and said rivet connection is disposed between the upper and lower flange connections.

* * * * *